US007841268B2

(12) United States Patent
Bailey

(10) Patent No.: US 7,841,268 B2
(45) Date of Patent: Nov. 30, 2010

(54) DEFENCE SYSTEM

(75) Inventor: Richard J. Bailey, Huddersfield (GB)

(73) Assignee: Environmental Defence Systems Limited, Huddersfield, West Yorkshire (GB)

( * ) Notice: Subject to any disclaimer, the term of this patent is extended or adjusted under 35 U.S.C. 154(b) by 0 days.

(21) Appl. No.: 11/972,317

(22) Filed: Jan. 10, 2008

(65) Prior Publication Data

US 2008/0250916 A1 Oct. 16, 2008

Related U.S. Application Data

(60) Provisional application No. 60/916,547, filed on May 7, 2007.

(30) Foreign Application Priority Data

Jan. 19, 2007 (GB) ..... 0701068.9
Sep. 5, 2007 (GB) ..... 0717299.2
Nov. 15, 2007 (GB) ..... 0722434.8

(51) Int. Cl.
*F41H 11/00* (2006.01)
*E04H 9/14* (2006.01)

(52) U.S. Cl. ..... 89/36.02; 89/920; 86/50; 405/114

(58) Field of Classification Search ..... 89/36.02; 86/50; 405/111, 116, 114
See application file for complete search history.

(56) References Cited

U.S. PATENT DOCUMENTS 4,555,201 A * 11/1985 Paoluccio ..... 405/117
4,650,368 A 3/1987 Bayer
5,158,395 A * 10/1992 Holmberg ..... 405/21
6,109,835 A * 8/2000 Grabhorn ..... 405/302.6
2004/0200339 A1 * 10/2004 Bishop et al. ..... 86/50

FOREIGN PATENT DOCUMENTS

EP 0 368 107 A1 5/1990

OTHER PUBLICATIONS

International Search Report issued Mar. 7, 2008 in PCT/GB2008/000185.

* cited by examiner

*Primary Examiner*—Bret Hayes
(74) *Attorney, Agent, or Firm*—Duane Morris LLP

(57) ABSTRACT

There is described a barrage unit comprising a porous bag or sack containing an absorbent core said absorbent core comprising an absorbent crystalline material and an absorbent fibrous material.

6 Claims, 10 Drawing Sheets

DEFENCE SYSTEM

FIELD OF THE INVENTION

The present invention relates to defence system, and in particular, but not exclusively, to suppression of blast and/or fragmentation pieces created during the detonation of explosive ordnance and/or a system capable of acting as a flood barrier. However, it will be appreciated that the invention is not limited to these particular fields of use.

BACKGROUND TO THE INVENTION

Sandbags are routinely used as a flood defence barrier or a blast suppression barrier. It will be well understood that sand bags can be built to form a wall or a dyke.

Thus, a typical way of building a flood barrier is to pile filled sandbags together to act as a barrage or darn, for example across a doorway, to prevent the ingress of water.

Similarly, a typical method used to suppress fragmentation, is to surround the ordnance with a wall of sandbags. This allows the ordnance to be detonated with little risk of the fragmentation damaging equipment or injuring personnel. The amount of sandbags required to build the protective wall are generally dependent on the type of ordnance to be disposed of. For example, detonation of an 81 mm HE mortar round typically requires a wall built from approximately 80 regulation size sandbags.

However, the disadvantages of using sandbags as a barrier, either a flood defence barrier or a blast suppression barrier, are numerous.

Firstly, a supply of particulate matter, such as sand or earth, must be located to fill the bags. Typically, the only source available is the surrounding ground or alternatively loose sand must be transported in. In the case of sand, if the sand is wet, it will significantly increase in weight and can therefore be very labour intensive and time consuming to fill bag and create a suitable defence wall. Alternatively, if bags are to be filled with earth or soil and the ground happens to be particularly dry and compact, attaining the filling for the bags can be extremely time and labour intensive. In either case, this is especially disadvantageous.

In addition, when used as a blast suppression wall, ordnance detonation teams tend to be quite small in numbers, making manpower a relatively scarce resource. Furthermore, bulky and heavy tools such as shovels must be transported to the site in order to fill the bags.

Alternatively, the sandbags may be pre-filled off-site and delivered to the location, However, not only does this place additional demands on transport resources, generally manpower is still required to fill the bags, and load and unload the vehicle.

Additionally, if pre-filled sandbags are stored in unfavourable conditions for an extended period of time, they are prone to perishing, rendering them useless and a waste of resources.

Also, as a blast suppressing means, sandbags can also bean inefficient, as the bag itself can be easily destroyed during detonation. Without a containing bag, the particulate matter contained within can do little to retard the impact of the fragments. Hence, an extensive quantity of sandbags may be required during detonation, depending on the blast fragmentation capacity of the explosive ordnance.

A further disadvantage of using sandbags is that they have limited ability to prevent the sound of detonation to the surrounding area. This can be problematic as many military ranges are located nearby residential housing where sound restrictions apply. Hence, loud detonation of ordnance may result in breaking of such restrictions.

During conflicts or war, it is common for defensive munitions to be laid in place in order to secure an area for tactical purposes, for example anti-personnel mines and cluster bombs. Unfortunately, many of these device's are not detonated during the conflict and remain in place long after the conflict has passed. This can cause serious risks for civilians; who return to the area, as they may unknowingly activate the munitions and do serious harm to themselves or others in the vicinity.

Furthermore, in military operations it is common for a small proportion of explosive ordnance devices to fail to detonate upon firing. In some instances, the unexploded ordnance is easy to locate. In other instances, the ordnance is difficult to locate and may lie undetected for an indeterminate period of time. In either case, once found, it is necessary to destroy the ordnance to ensure it does not detonate unexpectedly, potentially causing damage to equipment or injuring personnel.

Known devices for detonating unexploded ordnance and other munitions include electric detonators, plastic explosives and sub-munitions. Depending on the type of ordnance being destroyed and the type of detonator used, a range of blast fragment zones may result. In the circumstances where personnel or equipment may lie within the blast fragmentation zone, the range of impact of the fragmentations must be suppressed to avoid damage or injuries.

There have been numerous attempts to overcome the aforementioned problems, in particular with respect to flood barriers. However, a particular problem exists in the case of a flood defence barrier, since time may be of the essence to prevent the ingress of water and to prevent damage to property, etc.

One such flood defence system utilises a bag or sack containing a superabsorbent polymer. Such a system does provide advantages over the use of conventional sandbags, for example, they are easy to transport, are lightweight to carry and can be stored easily. However, such systems do suffer from a number of disadvantages in that the superabsorbent polymer will generally be loosely filled, enabling expansion of the polymer once it is wetted. Thus the polymer and/or the wetted gel may lie at one end of the sack and when the barrage units are stacked together a watertight seal may not be formed.

Furthermore, whilst superabsorbent polymers do possess a high capacity for water uptake, the rate of uptake is slow. This may be a significant disadvantage when building a flood defence barrier since the ingress of large amounts of water may have taken place before the superabsorbent polymer has swelled to a sufficient extent to form a barrier. For example, tests have shown that a sack filled with superabsorbent polymer alone may take ten minutes or more to absorb sufficient water to enable the bag or sack to act as a flood defence barrier.

The present invention has been made, at least in part, in consideration of the problems and drawbacks of conventional systems and attempts to overcome or mitigate the disadvantages present with conventionally known approaches.

STATEMENTS OF THE INVENTION

Thus, according to a first aspect of the invention we provide a barrage unit comprising a porous bag or sack containing an absorbent core said absorbent core comprising an absorbent crystalline material and an absorbent fibrous material.

The absorbent crystalline material is preferentially a polymeric material, such as a super absorbent polymer. A variety of superabsorbent polymers are available and such superabsorbent polymers may include polyacrylates and/or polyacrylamides, especially polyacrylate and/or polyacrylamide salts, such as the alkali metal salts, e.g. sodium or potassium salts. These types of substances can hold up to 200 times their own weight of water as the crystals can form an absorbent gelling polymer when saturated with fluid. It will be well understood by the person skilled in the art that mixtures of superabsorbent polymers may be used.

Other materials are also used to make a superabsorbent polymer, such as, polyacrylamide copolymer, ethylene maleic anhydride copolymer, cross-linked carboxy-methylcellulose, polyvinyl alcohol copolymers, cross-linked polyethylene oxide, and starch grafted copolymer of polyacrylonitrile.

The fibrous material preferably comprises a cellulosic material, for example, a pulp fibre, such as a wood pulp or fibre crop material, such as cotton pulp and the like. There are numerous other fibre crop materials available and it will be appreciated by the person skilled in the art that a number of such materials and/or mixtures of such materials may be used.

The ratio of absorbent crystalline material to absorbent fibrous material may vary and may depend on a number of factors, such as the nature of the crystalline material, e.g. the superabsorbent polymer, the nature of the fibrous material, e.g. pulp material and the use to which die bag or sack will be put, e.g. flood defence system or blast defence system. Thus, for example, of the total absorbent core, the fibrous material may comprise of from 40% to 80% by weight, preferably from 50% to 70% by weight, 55% to 65% by weight, the crystalline material making all or a substantial proportion of the remainder.

According to a further aspect of the invention we provide the use of a barrage unit containing ah absorbent core as a defence system wherein said absorbent core comprising an absorbent crystalline material and an absorbent fibrous material.

The use hereinbefore described may comprise use as a flood defence system or use as a blast defence system, e.g. suppressing blast and/or fragmentation pieces from explosives during detonation.

According to an additional aspect of the invention we provide a method of creating a barrage which comprises the use of one or more barrage units as hereinbefore described.

According to this aspect of the invention the barrage may comprise a defence system against flooding or blast and/or fragmentation pieces.

According to one aspect of the invention there is provided a method of suppressing blast and/or fragmentation pieces from explosive during detonation, the method comprising placing a barrage unit relative to the explosive prior to detonation such that upon detonation, the porous bag absorbs at least some of the blast fragmentation pieces.

We also provide a method of installing a barrage which comprises wetting one or more barrage units as hereinbefore described and building said barrage units into a wall.

In the method of installation the barrage units may be installed dry and wetted in situ or alternatively, the barrage units may be wetted prior to building a barrage wall. In this aspect of the invention the method may comprise installation of a flood defence system or installation of a blast defence system.

However, it will be understood that whilst it is known to use a porous bag or sack containing just an absorbent crystalline material as a flood defence barrier, the use of such a bag or sack as a blast defence system is not known and is therefore novel per se.

Therefore, according, to a yet further aspect of the invention we also provide the use of a barrage containing an absorbent crystalline material as a blast defence system as hereinbefore described.

When the absorbent core of the barrage unit as hereinbefore described comprises an absorbent crystalline material and an absorbent fibrous material the core may comprise an admixture absorbent crystalline material and an absorbent fibrous material. However, in a preferred aspect of the invention the absorbent core comprises alternating layers of absorbent crystalline material and an absorbent fibrous material. When the absorbent core comprises alternating layers a plurality of such layers may be present, for example, from 1 to 6 multilayers may be present (wherein a multilayer consists of a layer of a crystalline material and a layer of absorbent fibrous material), preferably from 2 to 5, more preferably 3 or 4 multilayers.

The bag or sack of the barrage unit may comprise any conventional material known as a sacking material, thus it may be a natural material or a synthetic material or a combination of such materials. Thus, an example of a natural material is a jute fabric and an example of a synthetic material is a loosely woven polypropylene. A jute fabric is preferred because of, inter alia, its hydrophilicity. Furthermore, when jute of other natural material is used, the bag or sack may be strengthened by using a liner. Preferably the liner comprises a hydrophilic material, such as, cotton and the like.

In a further embodiment of the invention the bag or sack may comprise a bulk bag. Bulk bags are conventionally used, for example, for the supply of bulk materials to the building trade. The bags may vary in dimensions, but they will generally have a capacity of from 500 kg to 2000 kg. Conventionally such bags may be provided with one more straps to facilitate lifting and/or an additional sleeve which, in use forms a closure. The bulks may comprise a variety of materials, but conventionally bags comprise a plastics, e.g. polypropylene, web material. Such bags are commercially available, e.g. the HIPPOBAG™. The bulk bags of the invention will be suitable for use a flood suppression unit and/or a blast suppression unit.

What follows is a description pertaining to the use of the bags or sack of the invention as a blast barrage. From the description herein it will be understood that according to the present invention a blast prevention bag or sack may comprise a crystalline polymer e.g. a superabsorbent polymer alone or a combination of a crystalline polymer and a fibrous material.

Thus, a small and lightweight (pre-saturation) bag can hold a large amount of water and thus provide a large amount of fragmentation—and blast-absorbing capability. The absorbent bag may be saturated prior to being positioned relative to the explosive or after being positioned relative to the explosive.

The bag may be formed in a variety of shapes. For example, prior to saturation, some bags may be substantially rectangular and planar in shape. Alternative shapes may utilised, such as an annulus, partial annulus, oval, or square/rectangular with the centre portion removed. Such bag shapes may enable a reduced number of bags to be used, thus providing for an easier construction of any necessary containment structure and potentially reducing the amount of time that explosives disposal personnel need to spend in the immediate vicinity of the device to be detonated.

A number of bags may be used together in a configuration to completely or partially surround an explosive. To achieve this, the bags may be arranged in an overlapping configuration such as a might conventionally be used to construct a wail or other structure from sandbags or construction blocks. In some examples, the structure may at least partially enclose the explosive from above as well as at a side. For such an example, an igloo type shape structure might be appropriate.

The bags may be used to suppress fragmentation for a range of explosive devices such as, landmines, unexploded air launched ordinance including cluster bomb "bomblets" and other air-dropped bombs, unexploded ground-launched ordinance such as thrown or fired grenades, mortar shells and artillery shells. Specific tests have been carried out to judge the efficiency of the bags at containing the fragmentation and/or blast from various landmines, cluster bomb "bomblets" and mortar shells as these are types of ordinance which have often left behind to kill, injure or maim civilians in recent conflicts around the world. The efforts of the inventors have therefore centred on developing a system for dealing safely with devices of this type. Various detonation devices used to detonate the explosive ordnance may include electrically activated high explosive detonators such as might be designed for detonating explosive placed charges in the mining or quarrying industries. Detonators might include wire-activated detonators, time-fused detonators, or chemical fused detonators. Detonators might also include impact or pressure-based detonators which can be activated by launching or throwing heavy objects onto the ordinance after placement of the waterbag screen. This approach could also be used to detonate pressure-sensitive ordinance such as landmines without the need for a separate detonator. Also, the pressure sensitive ordinance such as landmines, detonation could be achieved by laying waterbags directly over as well as around the ordinance and using the pressure caused by the increasing weight of the waterbag as water is applied to cause detonation. These "tow-tech" detonation approaches may have particular application in locations were a supply of detonators is expensive and hard to transport securely and safely, such as many remote regions were guerrilla armies or government forces may have placed minefields in order to hamper one-another's movements.

The absorbent bags may be in the form of a 'waterbag'. However, fluids other than water may be used to saturate the bag, the main requirement for such being that the fluid will not ignite or burn when the explosive is detonated.

Use of absorbent bags as described above avoids the time consuming and labour intensive task of filling sand bags with particulate matter.

Furthermore, trials using waterbags to suppress the blast and fragmentation of explosive ordnance have shown that the waterbags are generally more efficient than sandbags at retarding the range of impact of the fragmentation pieces and at reducing the blast effects from the ordnance. Consequently, fewer bags tend to be required to protect personnel and equipment within a blast fragmentation zone.

Additionally, the sound absorbing qualities of the gel within the waterbag were found to be generally superior to that of sand. Hence, use of absorbent bags or waterbags can potentially reduce the penetration of sound generated during detonation.

BRIEF DESCRIPTION OF THE DRAWINGS

Specific embodiments will now be described, by way of example only, with reference to the accompany drawings in which.

Figure 1A:
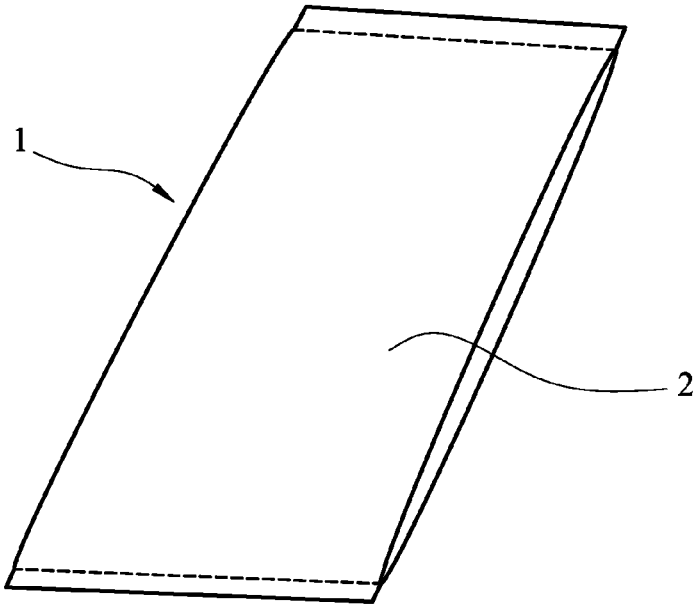
FIG. 1*a* is a perspective view of a barrage unit suitable for use in suppressing fragmentation of explosive ordnance, shown prior to saturation with fluid.
Figure 1B:
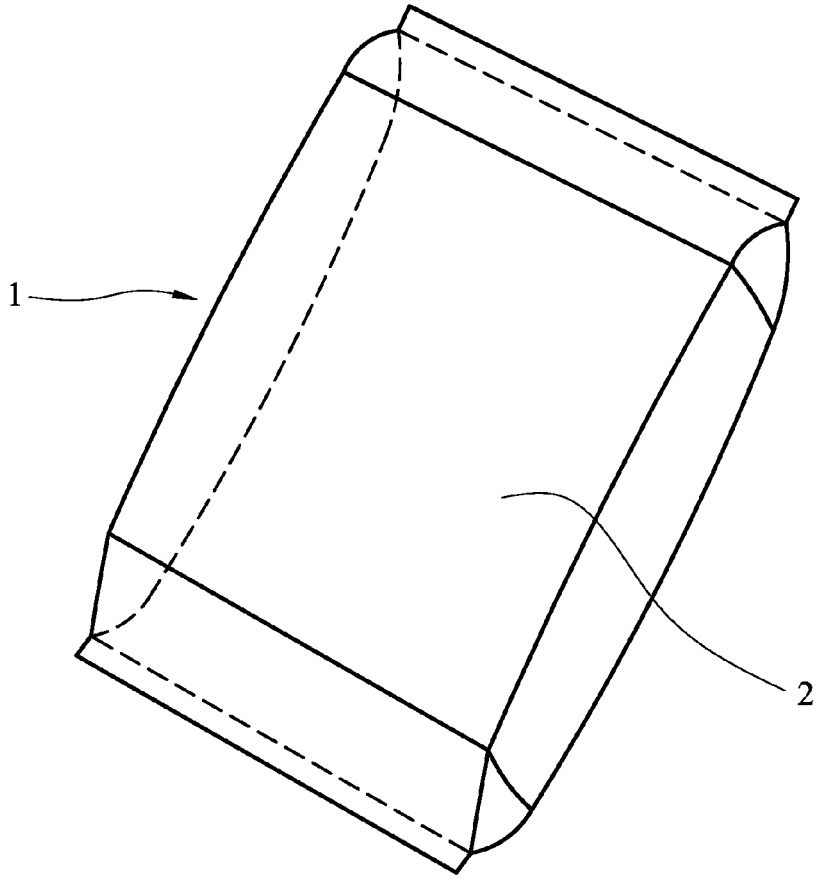
FIG. 1*b* is a perspective view of the barrage unit of FIG. 1*a*, shown after saturation with fluid.

While the invention is susceptible to various modifications and alternative forms, specific embodiments are shown by way of example in the drawings and are herein described in detail. It should be understood, however, that drawings and detailed description thereto are not intended to limit the invention to the particular form disclosed, but on the contrary, the invention is to cover ail modifications equivalents and alternatives falling within the spirit and scope of the present invention as defined by the appended claims.

DETAILED DESCRIPTION OF THE INVENTION

Referring to the drawings, the absorbent bag 1 includes an outer lining 2 comprising a material such as heavy duty absorbent paper and an absorbent sore 3.

Figure 2A:
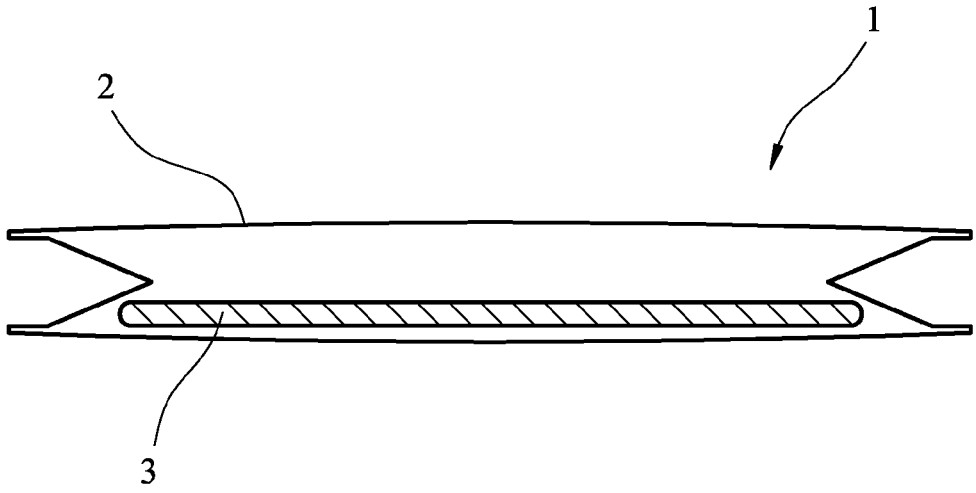
FIG. 2*a* is a cross-sectional side view of the barrage unit of FIG. 1*a*
Figure 2B:
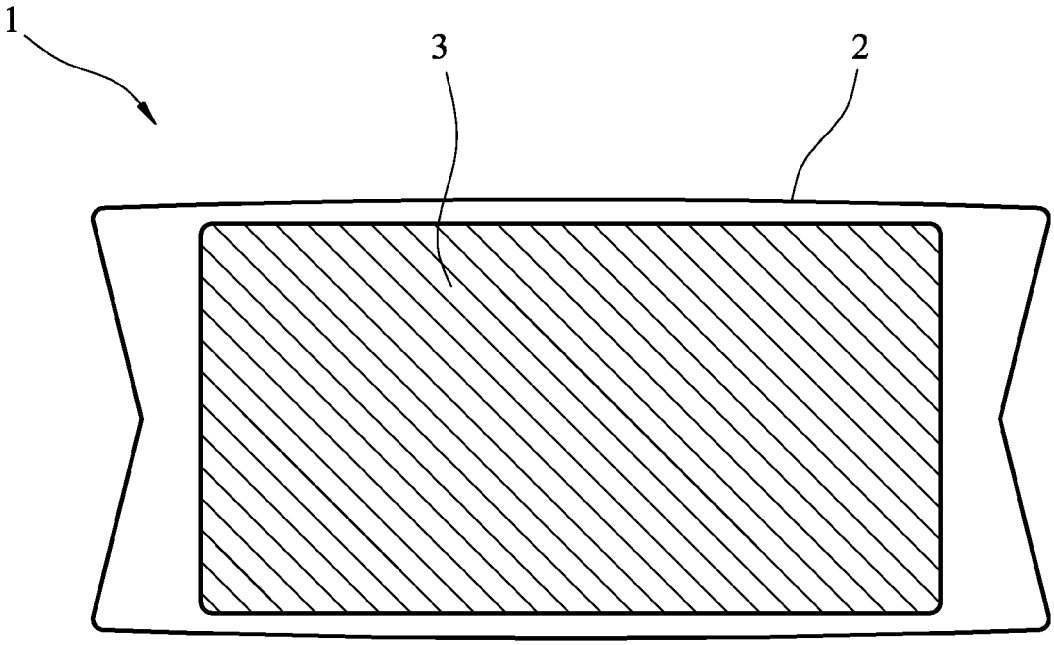
FIG. 2*b* is a cross-sectional side view of the barrage unit of FIG. 1*b;*

The absorbent core 3 includes, absorbent crystals. As illustrated in FIG. 2*a*, these crystals have low volume when dry and so make the bag low in bulk for storage and transportation. When the bag 1 is saturated, the crystals absorb a large amount of fluid to form an absorbent gelling polymer capable to retaining fluid, such as water. This is illustrated in FIG. 2*b* where it is clear that the volume of the absorbent core 3 has significantly increased over the above and dry or unsaturated state. Preferably, the gelling polymer is able to retain the fluid even whilst underpressure from the weight of any bags which may be layered above. Absorbent crystals suitable for use in the absorbent core include, so-called super-absorbent polymers, including the product Super Absorbent Polymer™. Such crystals may include sodium polyacrylate (which is used in many disposable nappies/diapers for children and infants) or a polyacrylamide with a potassium salt base (which in feet is a slow-release agent sometimes used in soil moisture applications). These types of substances cart hold up to 200 times their own weight of water.

The bags may be saturated either in situ or off-site and then transported to the location where there bags will be used. According to the present examples, use of the bags will be to reduce the fragmentation and/or blast and/or noise effects of an explosive device such as an item of explosive ordnance. The explosive could be almost any of launched, dropped or fired explosive such as rockets or mortar shells. The explosive could also be a placed explosive, which could be triggered to explode by pressure sensor, proximity sensor, material type sensor (e.g. magnetic sensor), disturbance sensor (e.g. tripwire) or timer. Examples of such could include mines, cluster bombs "bomblets", demolition charges, ear bombs and other devices such as may be used by any form of military or paramilitary organisation.

In the case where the bags are saturated in situ, all the bags may be saturated nearby and then subsequently stacked to form the protective wall.

Alternatively a first layer of bags may be placed in location adjacent the explosive ordnance and then saturated. This process is can then be repeated for each subsequent layer of bags until a suitable height is reached.

In other examples, a number of layers may be placed simultaneously and then saturated together. Primarily water is used to saturate the bags as it is generally a readily available source of fluid. However other fluids may be used in substitution, such as, any other fluid which would not explode or burn as a result of the detonation of the ordinance.

In use, many differing amounts and layouts of bags may be used to build the protective wall or structure adjacent the explosive ordnance. The arrangement will depend on the type of explosive to be detonated and the type of detonation device used.

Figure 3:
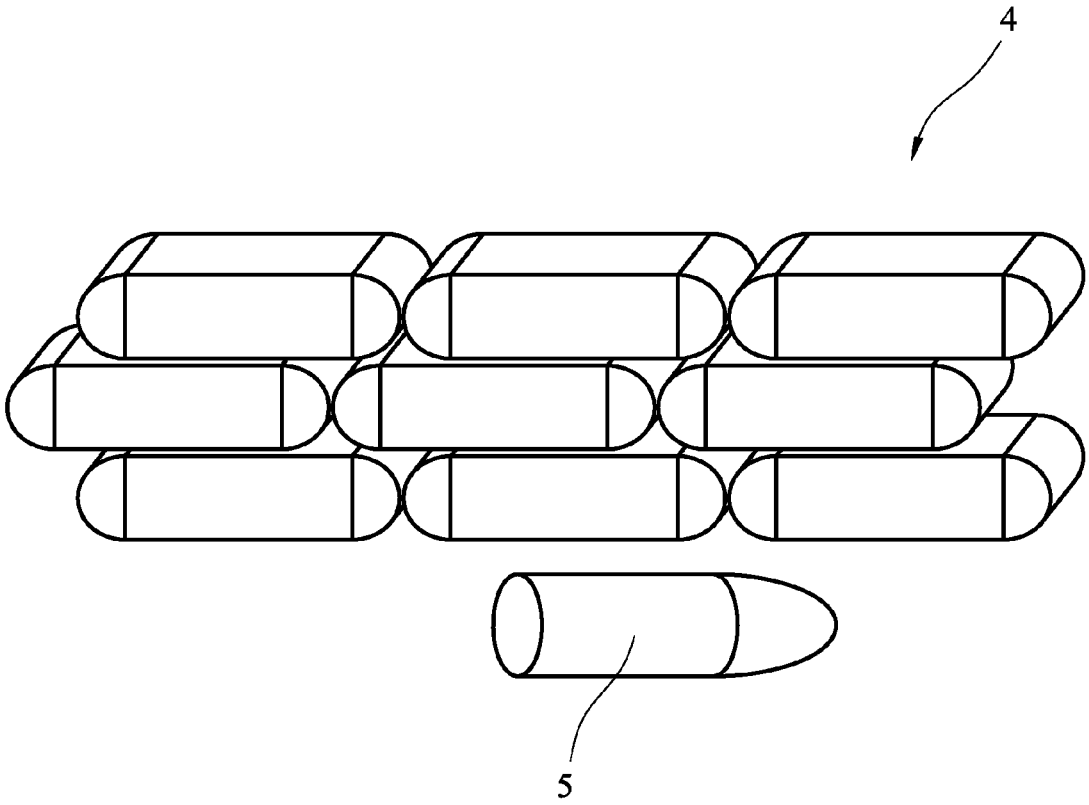
FIG. 3 is a perspective view, of a wall of barrage units positioned adjacent a unit of explosive ordnance in accordance with one embodiment.
Figure 4:
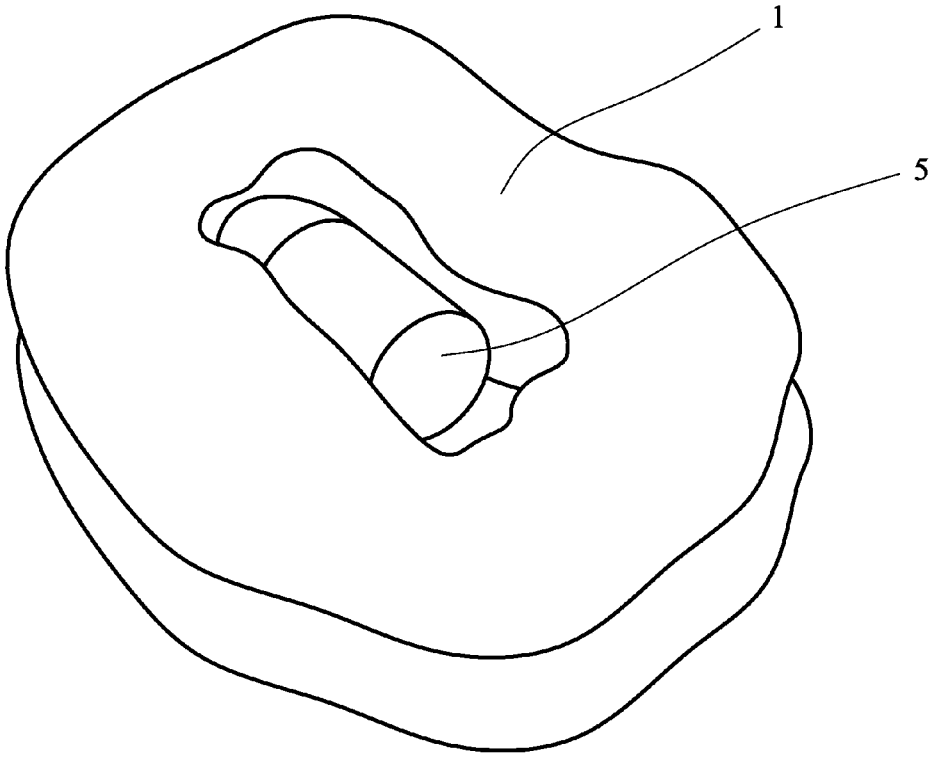
FIG. 4 is a perspective view of two barrage units in the shape; of a square/rectangle (with a hole in the centre) laid one on top of the other, surrounding an explosive device.
Figure 5:
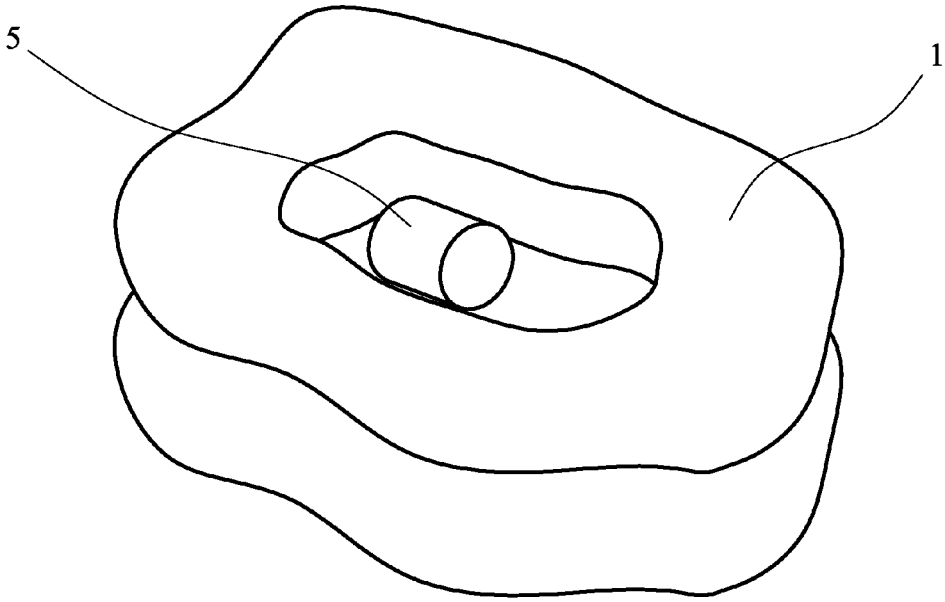
FIG. 5 is a perspective view of the barrage units in FIG. 6, shown surrounding an alternative type of explosive device.
Figure 6:
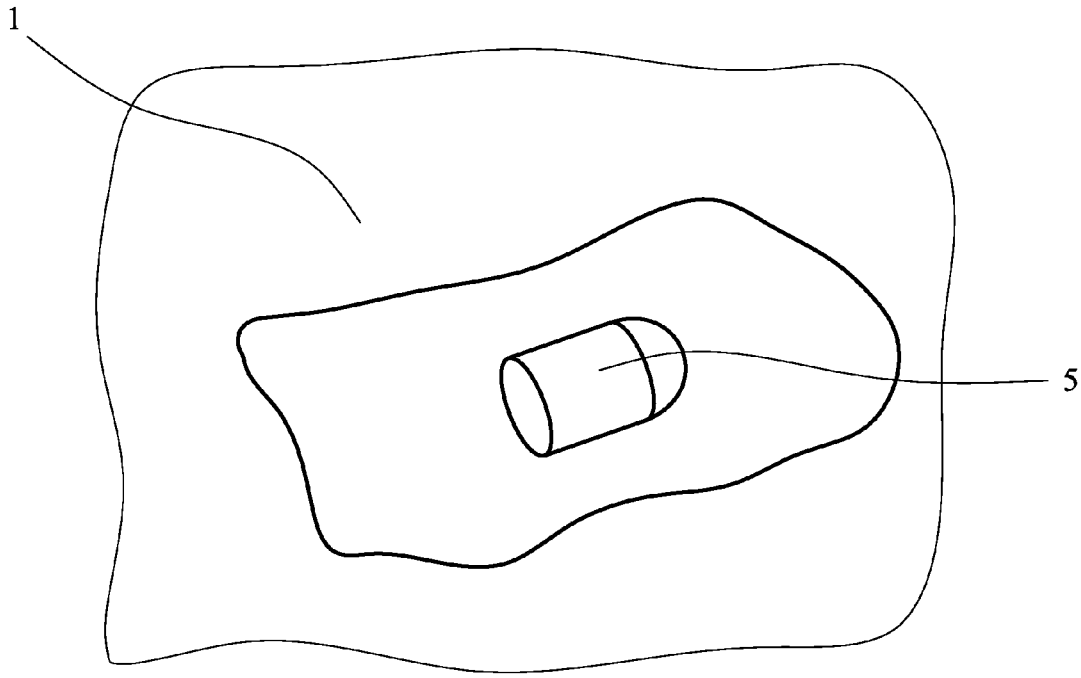
FIG. 6 is a perspective view of the barrage units in FIG. 6, shown surrounding another alternative type of explosive device.
Figure 7:
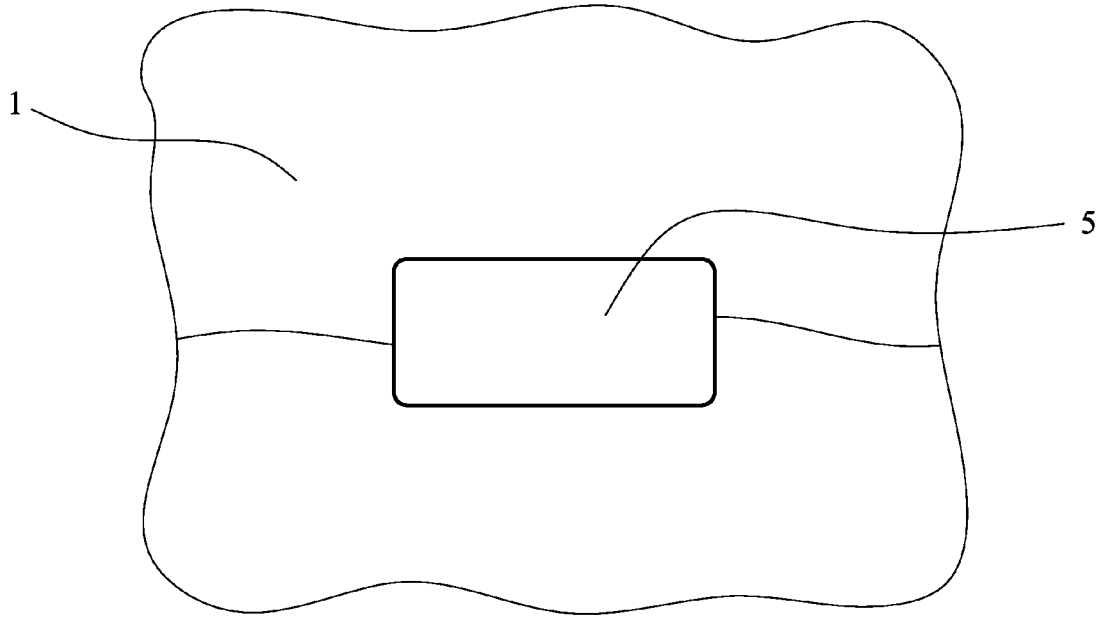
FIG. 7 is a side view of the stacked barrage units surrounding an explosive device.

For example, when detonating explosive ordnance that failed to explode upon impact, or landmines and cluster bombs left in a civilian are, the structure might comprise a wall built surrounding the device. The wall might be constructed by randomly stacking bags or by laying the bags in a deliberate pattern. An example of a simple wall layout 4 arranged adjacent an explosive device 5 is shown in FIG. 3. In some examples, a wall of bags may be constructed according to a recognised bricklaying type pattern, such as a stretcher, Flemish or English bond. Alternatively, a wall configuration as shown in FIGS. 4, 5 and 6 may be used. These figures illustrate the use of two bags which are substantially square/rectangular in shape, having a centre portion removed. The bags are stacked one on top of the other and are positioned so that the explosive device 5 is surrounded by the bag. Saturation has caused the bags to begin swelling to form a wall portion surrounding the explosive. If greater blast suppression is required, more layers can be added prior to detonating the explosive device. The arrangement shown in FIG. 4 illustrates an 88 lb mortar shell and the arrangements shown in FIGS. 5 and 6 illustrate landmines.

For some explosives, a wall having a thickness of a single standard sandbag sized bag might be sufficient. For other, more powerful explosives, a greater wall thickness might appropriate.

In one trial, a UK BL755 cluster bomb sub-munition ("bomblet") was detonated using a 4 oz (0.12 Kg) PE4 charge from a position underneath a stack of 9 saturated bags. Each bag used in this trial was substantially rectangular and had dimensions 450×570 mm and was saturated with approximately 20 litres of water. Witness screens were erected at lift and 5 m distances. Following the detonation, no fragmentation damage was observed at either witness screen. Some of the bags were damaged by the fragmentation pieces and the blast, and some pieces of saturated gel from the bags were observed to have been distributed up to 5 m from the munition.

In another trial, an L36A2 81 mm high explosive mortar shall was placed in the centre of a surrounding wall, consisting of 80 bags laid three courses high. The shell was detonated using an 8 oz (0.23 Kg) PE4 charge using L2A1 electric detonator. Witness screens were placed at 5 m distance. Following the detonation, no fragmentation damage was observed on any witness screen. The bags were scattered in a localised area around the shell. The overall effectiveness in mitigating blast and fragmentation was observed to be approximately equal to that provided by a wall consisting of 80 regulation size sandbags.

In some examples, the explosive may be located other than on a ground surface. In one example, explosive may be located within a motor vehicle. In such an example, it might be appropriate to build a wall around the motor vehicle and/or to cover die motor vehicle with bags.

In some examples, it may be desirable to place one or more bags directly over the explosive. In cases where the explosive is pressure sensitive, the bag or bags may be placed over the explosive in an unsaturated state and then exposed to liquid to saturate the bag. Such an arrangement could be used for clearing of minefields, where unsaturated bags placed over the mine would be insufficient to detonate the mine. The bags could then be saturated from a safe distance using, for example, a hose to the bags or by spraying liquid from a distance. As the bags saturate the weight will increase, eventually reaching a loading sufficient to detonate the mine. However, by the time the mine is detonated, the bag or bags will be sufficiently saturated to limit the blast effect from the mine. This system could be applied to both anti-personnel and anti-vehicle mines, with the number of bags used being adjusted according to the pressure loading required to detonate the mine and the expected explosive power of the mine.

It will be appreciated that the illustrated methods for suppressing blast fragmentation pieces during the detonation of explosives is relatively quick to prepare and may reduce the likelihood of injury to a user or damage to equipment.

Figure 8:
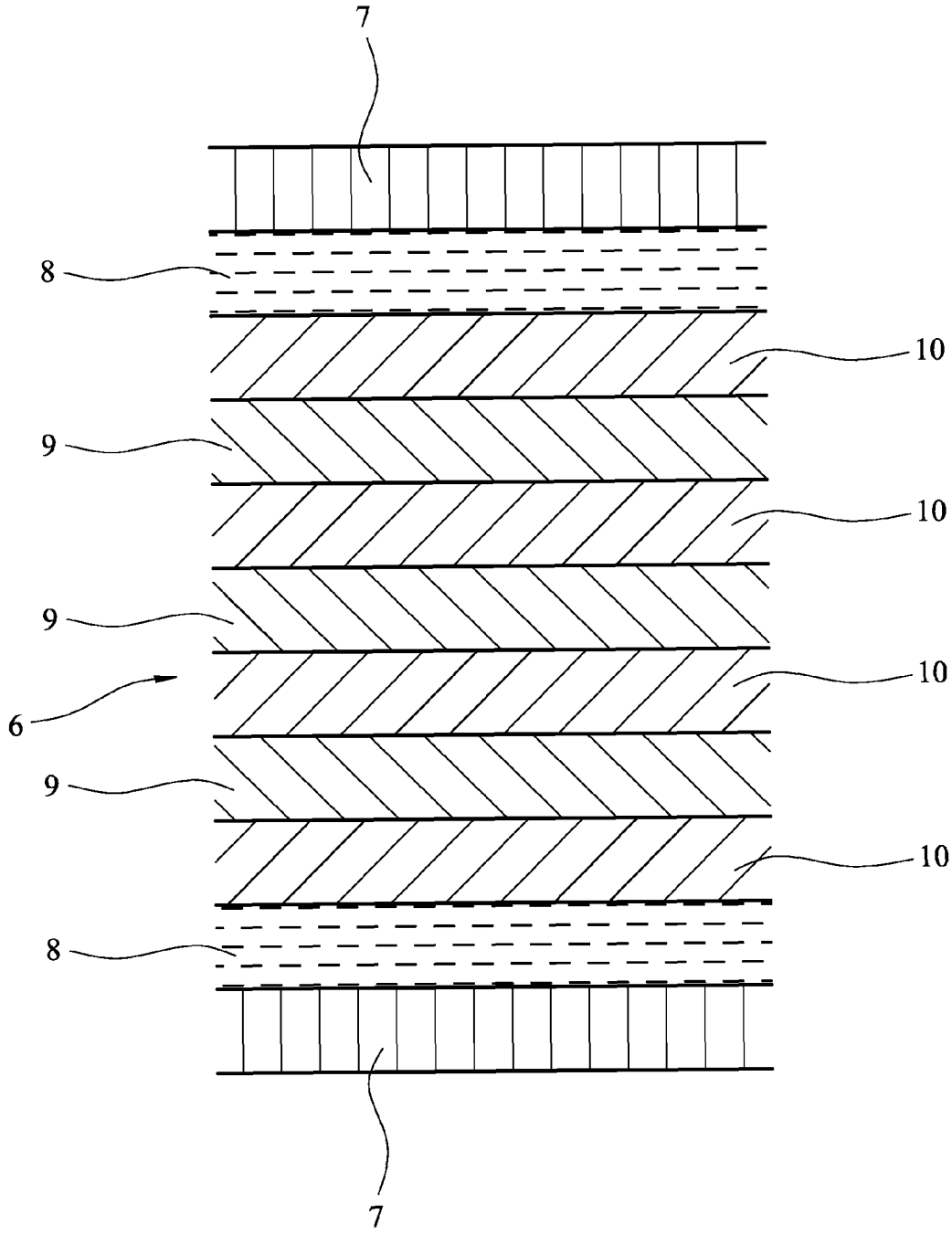
FIG. 8 is a schematic representation of a multilayered barrage unit according to the invention;.

Referring to FIG. 8, in a preferred aspect of the invention the barrage unit 6 comprises a jute fabric outer sack 7 and a hydrophilic polymer liner 8. The sack/liner houses a plurality of alternating layers of SAP 9 and pulp fibre 10

Figure 9:
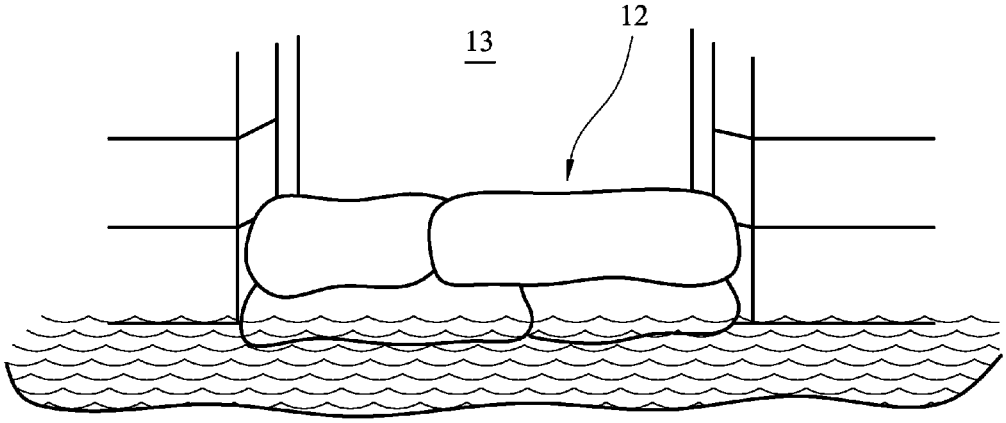
FIG. 9 is a perspective view of stacked barrage units according to the invention as a doorway flood barrier.
Figure 10:
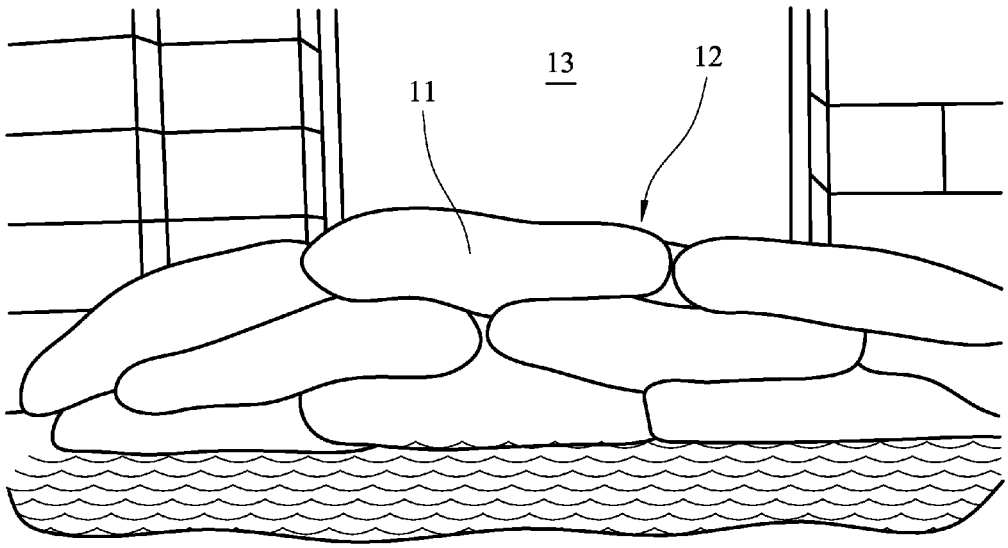
FIG. 10 is a is a perspective view of stacked barrage units according to the invention as an extended doorway flood barrier.

Referring to FIGS. 9 and 10, barrage units 11 were stacked together to form a dam 12 across a door 13. It is apparent that a water tight barrage was formed.

Figure 11:
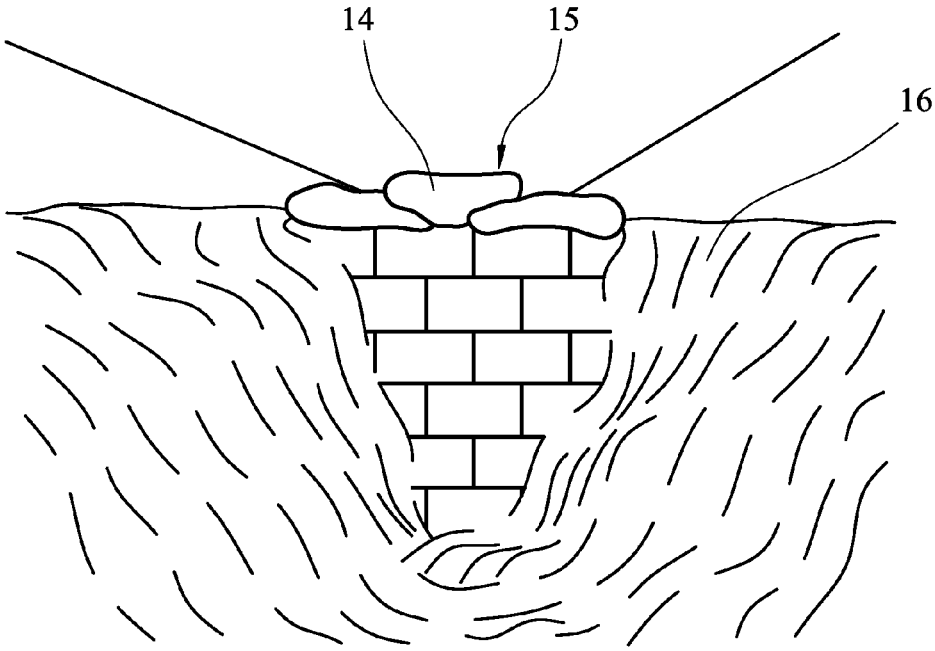
FIGS. 11 and 12 are views stacked barrage units according to the invention as a dam.
Figure 12:
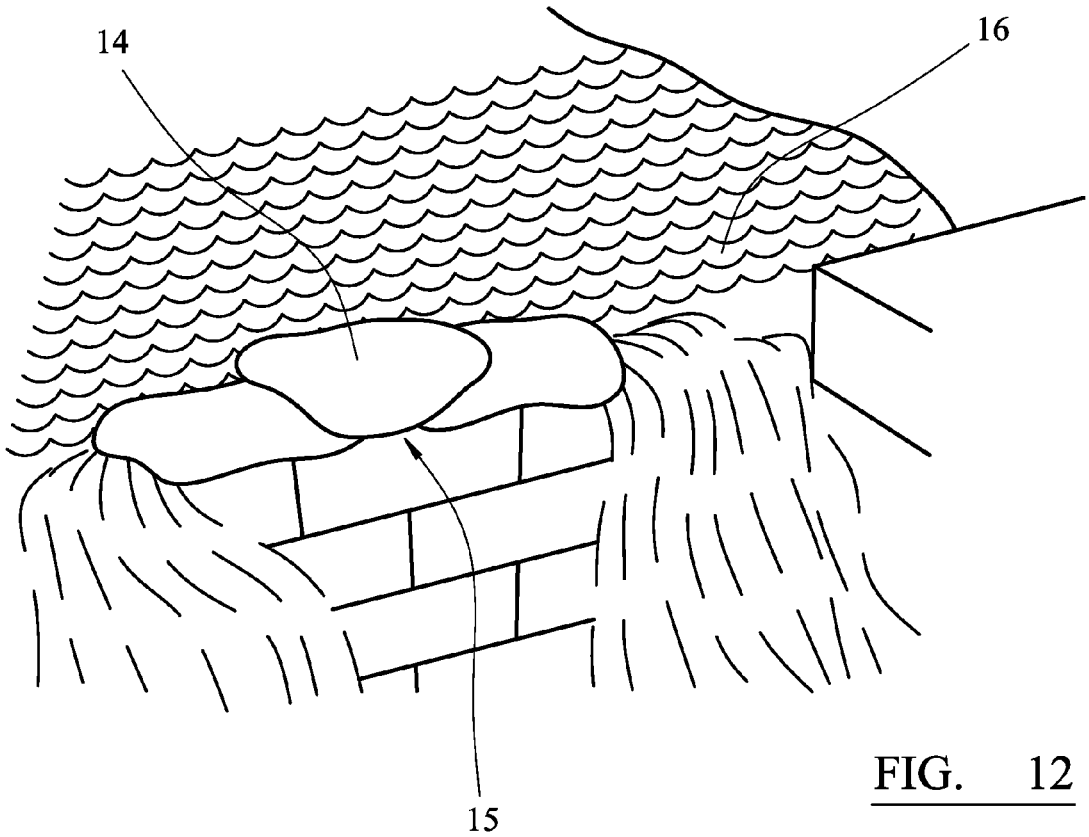

Referring to FIGS. 11 and 12, barrage units 14 were stacked together to form a dam 15 across a stream 16. It is clear that the flow of the stream 16 does not breach the dam 15.

Figure 13:
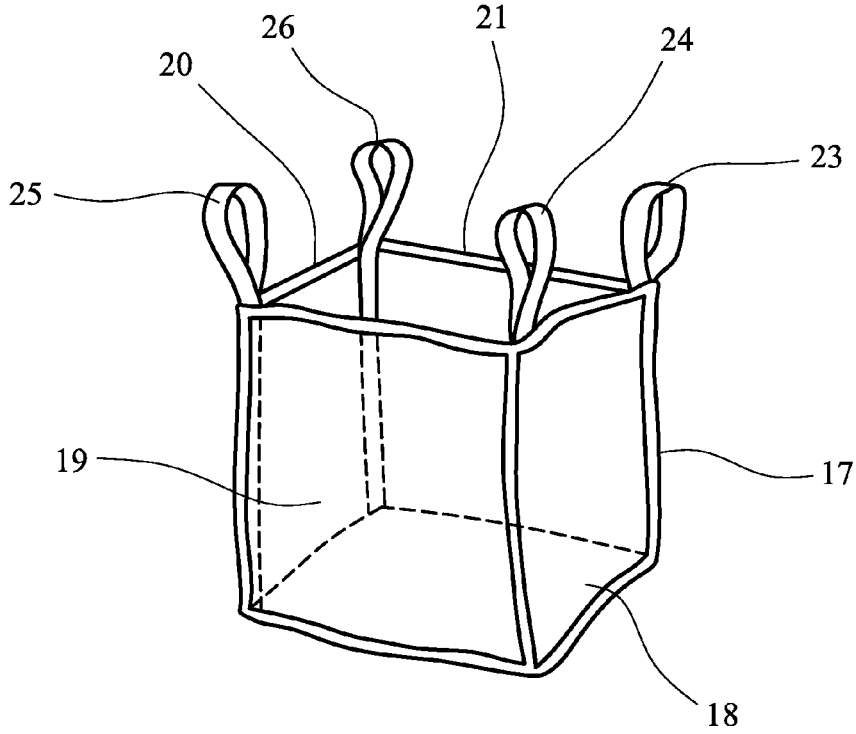
FIG. 13 is a schematic representation of a bulk bag of the invention.

Referring to FIG. 13, a bulk bag 17 comprises a sack provided with side walls, 18, 19, 20 and 23; and a base 22. Prior to use, the bulk bag of the invention will be lightweight 23 and may be lifted manually. However, in order that such bulk bags may be lifted once wetted, straps 23, 24, 25 and 26 are provided at each corner of the bag 17.

Figure 14:
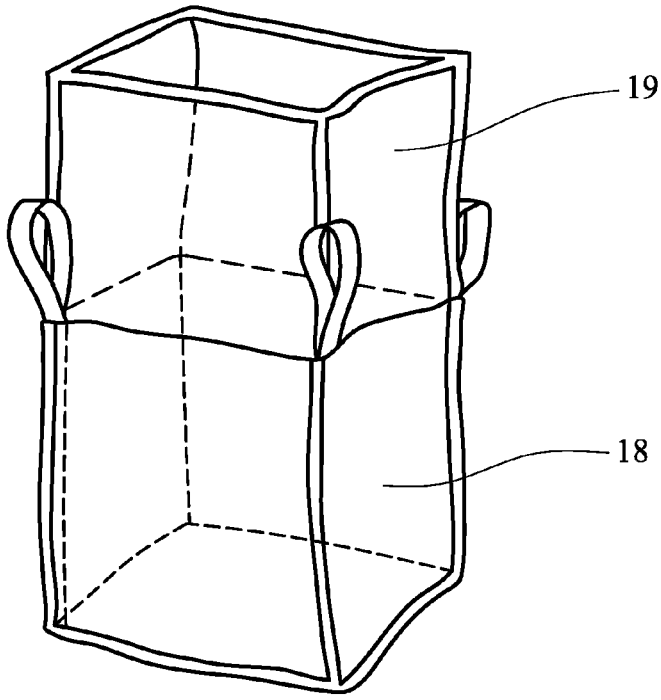
FIG. 14 is a schematic representation of a bulk bag of the invention provided with a foldable sleeve.

Referring to FIG. 14, a bulk bag 18 is provided with a sleeve 19, Once the bulk bag 18 is filled with an absorbent crystalline material and/or an absorbent fibrous material (not shown), the sleeve 19 may be folded to act as a closure.

Figure 15:
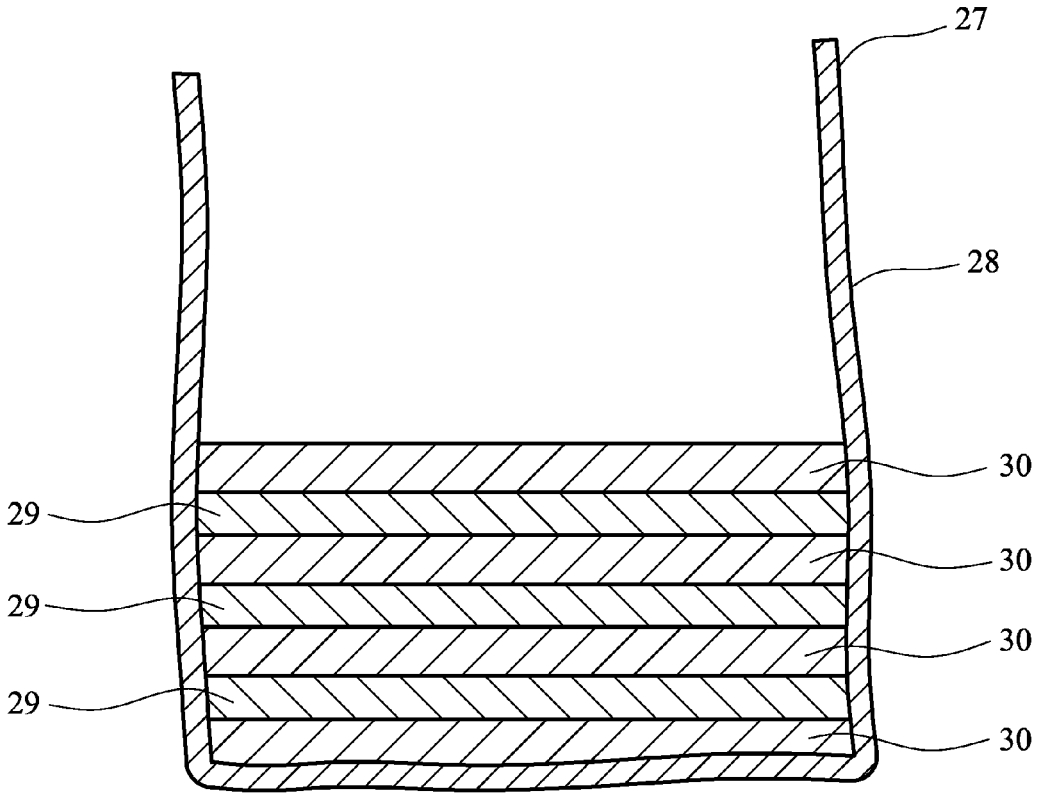
FIG. 15 is a cross section of a filled bulk sack of FIG. 13.

Referring to FIG. 15, a bulk sack 27 comprises a polypropylene outer fabric 28 and optionally a hydrophilic polymer liner (not shown). The sack 27 houses a plurality of alternating layers of SAP 29 and pulp fibre 30.

Although the invention has been described with reference to the above specific examples, it will be appreciated by those skilled in the art that the invention can be embodied in many other forms.

The invention claimed is:

1. A method of creating a blast defence barrage comprising the steps of:

(a) providing one or more porous bag or sack containing an absorbent core; said absorbent core comprising an absorbent crystalline material, said absorbent crystalline material comprising a superabsorbent polymer;

(b) positioning said one or more porous bag or sack relative to an explosive prior to detonation of the explosive; and, (c) saturating said one or more porous bag or sack wherein said one or more porous bag or sack is placed over said explosive such that during saturation the weight increase of said bag or sack detonates said explosive;

said one or more porous bag or sack being arranged such that on detonation of the explosive the one or more bag or sack suppresses at least some blast and fragmentation pieces produced by the detonation of the explosive by absorbing said pieces.

2. A method as claimed in claim 1, wherein said one or more bag or sack is arranged to form a wall which partially surrounds said explosive.

3. A method as claimed in claim 1, wherein said one or more bag or sack is arranged to form a wall which completely encloses said explosive.

4. A method as claimed in either claim 2 or claim 3, wherein said one or more bag or sack is randomly laid to form said wall.

5. A method as claimed in claim 1, wherein said explosive includes one or more of mortar shells, artillery shells, cluster munitions and other air-delivered munitions.

6. A method as claimed in claim 1, wherein said explosive includes one or more of sensor bombs, timer bombs, mines, cluster bombs, or home-made explosives or bombs.

* * * * *